United States Patent [19]

Herron

[11] 4,097,198

[45] Jun. 27, 1978

[54] INTERNAL COMBUSTION ASSISTED HYDRAULIC ENGINE

[76] Inventor: Allen R. Herron, 26235 Ravenhill Rd., Canyon Country, Calif. 91351

[21] Appl. No.: 741,881

[22] Filed: Nov. 15, 1976

Related U.S. Application Data

[63] Continuation-in-part of Ser. No. 506,992, Sep. 18, 1974, Pat. No. 3,995,974.

[51] Int. Cl.[2] ..... F04B 17/00; F04B 23/06; F04B 27/08; F04B 49/00

[52] U.S. Cl. ..... 417/245; 417/248; 417/288; 417/380; 417/396; 417/401; 417/427; 417/521

[58] Field of Search ..... 417/245, 248, 254, 286, 417/288, 317, 380, 393, 396, 398, 399, 401, 403, 521, 427

[56] References Cited

U.S. PATENT DOCUMENTS

| | | | |
|---|---|---|---|
| 1,741,731 | 12/1929 | Nordensson | 417/396 |
| 2,239,715 | 4/1941 | Hollander et al. | 417/393 |
| 2,247,261 | 6/1941 | Towler et al. | 417/288 |
| 2,381,298 | 8/1945 | McCormick | 417/280 |
| 2,466,132 | 4/1949 | Tetreault | 417/396 |
| 3,329,133 | 7/1967 | Panhard | 417/403 |
| 3,368,458 | 2/1968 | Shinaver | 417/398 |
| 3,499,387 | 3/1970 | Zippel | 417/399 |
| 3,682,565 | 8/1972 | Yarger | 417/288 |

*Primary Examiner*—John J. Vrablik

*Attorney, Agent, or Firm*—Spensley, Horn & Lubitz

[57] ABSTRACT

This hydraulic engine utilizes two sets of hydraulic cylinders connected to a shaft so as to be alternately pressurized as the shaft is reciprocally driven by a pair of conventional internal combustion chambers. The outlets of all hydraulic cylinders are connected to a common output line via valves. During each power stroke certain of the hydraulic cylinders being pressurized are selectively disconnected (depressurized) from the output line. This effectively decreases the load on the driving chamber, and insures a relatively constant, high pressure hydraulic fluid output level despite changes in supplied force during each power stroke. The selective cylinder disconnection may be implemented programmatically in response to changes in engine parameters such as combustion pressure. The engine also includes a pump for supplying input hydraulic fluid to each set of cylinders while that set is not being compressed. The input fluid force is additive to the power supplied by the operative combustion chamber. The pump is driven by pressurized fluid from the output line, and includes a flywheel with sufficient inertia to maintain pumping, and hence continue engine operation during periods of reduced output in one of the combustion chambers. In an alternative embodiment, there is no selective depressurization, the output pressure being maintained at a constant high level even during periods of reduced combustion chamber output by the cooperation of the flywheel and pump.

9 Claims, 6 Drawing Figures

CONTROL CIRCUIT
INTAKE
EXHAUST
SOLENOID
HYDRAULIC OIL COOLER
CLUTCH VALVE
ACC.
REL
FLY WHEEL
STARTER MOTOR
PUMP
FILTER
ACC
REL
CONTROL CIRCUIT
INTAKE
EXHAUST
SOLENOID

INTERNAL COMBUSTION ASSISTED HYDRAULIC ENGINE

BACKGROUND OF THE INVENTION

1. Related Applications

This application is a continuation-in-part of the inventor's copending application Ser. No. 506,992 now U.S. Pat. No. 3,995,974 filed Sept. 18, 1974.

2. Field of the Invention

The present invention relates to an internal combustion powered hydraulic engine in which the amount of hydraulic fluid that is pressurized is selectively altered during the combustion cycle.

3. Description of the Prior Art

In an era of growing concern for environmental pollution, decreasing reserve of fossil fuels and increasing gasoline prices, the efficiency of energy conversion in automobile and other engines is of extreme importance. The shortcomings of the conventional internal combustion engine in these areas are well known. Limitations inherent in the fundamental engine design result in less than optimum efficiency. Incomplete combustion necessitates complex smog control devices.

These inefficiencies result in part from the mechanical arrangement in a conventional reciprocating internal combustion engine. Each piston is connected via a connecting rod and crankpin to a crankshaft which itself delivers the output power. The speed of rotation of this crankshaft thus dictates the rate at which combustion must occur. The crankpin pressure angle dictates the points of acceleration, deceleration and stopping of the associated piston. During combustion, the burning gases must expand and exert force against the piston under conditions of acceleration dictated by the crankshaft and crankpin. Yet the optimum efficiency gas expansion rate seldom will be equal to the increasing cylinder volume dictated by the piston motion. Similarly, the piston must stop at the top and bottom limits of the crankpin travel. However, at the bottom limit, the gases in the cylinder may still be expanding, and could provide additional useful work. Inertial forces are absorbed at these top and bottom limits by the connecting rod and crankpin; this energy is lost.

An object of the present invention is to provide an engine in which the combustion rate is not dictated by mechanical crankshaft limitations and in which inertial forces are recovered as useful work. More complete combustion and more efficient energy conversion is achieved by using an internal combustion assisted hydraulic engine.

A known hydraulic drive internal combustion engine is disclosed in the U.S. Pat. No. 2,661,592 to Bright. In that engine, the piston of an internal combustion chamber is connected via a bell crank to the plunger of a single hydraulic cylinder. During the combustion cycle, hydraulic fluid in the cylinder is compressed. The pressurized fluid is used to drive a liquid turbine that turns an output shaft. Some of the pressurized fluid is stored by an accumulator which provides pressurized fluid to the turbine when the hydraulic cylinder is not being compressed. This stored pressurized fluid also is used to return the piston in the combustion chamber to the position at which gas is compressed and ready for combustion. To this end, the plunger in the hydraulic cylinder also is connected to another piston that is subjected to the force of the pressurized hydraulic fluid during the fuel compression cycle.

In engines of the type just described, the output fluid pressure level is limited by the resistive force of the output accumulator. The force exerted by the combustion chamber at the end of its power stroke must be at least equal to this relatively fixed accumulator resistive force in order to move additional pressurized output hydraulic fluid into the accumulator. As a result, if the hydraulic chamber is connected directly to such an accumulator or like pressurized storage arrangement, the pressure in that accumulator must remain at the minimum value obtained near the end of the cycle. Otherwise, the higher pressure from the accumulator would exert a counter-force on the hydraulic piston that would prevent further compression and perhaps stop the engine. As a result, high pressure at the beginning of the power stroke cannot be obtained, resulting in a substantial loss of efficiency.

Another object of the present invention is to provide an internal combustion assisted hydraulic engine in which the output hydraulic fluid pressure level is maintained at or near the maximum value available at the beginning of the power stroke. To this end, a variable displacement fluid system is employed in which the amount of displaced hydraulic fluid decreases as the forces acting on the piston decrease. As a result, the output hydraulic fluid varies in volume, but is maintained at a high pressure level. Much higher conversion efficiencies are acheieved than are possible with prior art engines.

Another shortcoming of prior art hydraulic engines relates to misfiring. If a misfire occurs, there is no force to drive fluid into the output accumulator. Misfire detection circuitry and special valves are required in prior art engines to allow cycling without the combustion assist. A further object of the present invention is to provide a hydraulic engine which does not require special detection systems to compensate for misfiring.

Another limitation of prior art hydraulic engines results from their use of large input and output fluid accumulators in which the pressure cannot be changed quickly. As a result, such engines must operate with equal power strokes. In contrast, it is an object of the present invention to provide a hydraulic engine capable of operating with strokes of different power, and utilizing a small output accumulator to smooth the pressure and volume variations of a few strokes. This allows the inventive engine to operate under different conditions of acceleration, deceleration and output pressure over a short period of time. As a result the engine is capable of operating efficiently at different speeds, rates of acceleration and deceleration, and under differing power loads. This is particularly useful in automobile applications where a wide variety of operating conditions are encountered.

Another object of the present invention is to provide a hydraulic assisted combustion engine wherein energy stored in a flywheel driven by the output hydraulic fluid pressure is used to boost the input pump pressure, and thereby maintain the engine output pressure at a constant high level, even during periods of reduced combustion chamber output.

SUMMARY OF THE INVENTION

These and other objectives are achieved by providing an internal combustion or pressurized gas assisted hydraulic engine in which the hydraulic fluid pressure load is changed selectively during the power stroke. Advantageously the load is reduced as the combustive force decreases, so that a relatively constant output hydraulic fluid pressure is obtained during the entire cycle.

In a preferred embodiment the engine employs two combustion chambers which face each other and are connected by a common shaft. Two sets of hydraulic cylinders are attached to the shaft. Alternate combustion in the two chambers causes the shaft to reciprocate, resulting in compression of first one and then the other set of hydraulic cylinders. The outputs of all the cylinders are connected via one-way valves to a common output line. However, the individual hydraulic cylinder outputs can be vented to a much lower reservoir pressure, thereby effectively disconnecting the output of that cylinder from the output line.

Disconnection or venting of the selected cylinders is accomplished by a set of valves that are actuated in some preset order, or in direct response to system parameters such as the pressure in the combustion chamber. For example, the high pressure fluid output of all cylinders may be connected to the output line at the beginning of the power stroke. Then, each time that the combustion chamber pressure drops by some selected amount, an additional hydraulic cylinder is vented. Thus consecutively fewer cylinders are included in the load. The output line hydraulic fluid pressure remains relatively constant, although the output fluid volume is reduced. A small accumulator is sufficient to smooth out volume or other variations as successive cylinder outputs are disconnected. While one set of hydraulic cylinders is being pressurized, the other set is being supplied with fluid at slightly above reservoir pressure. This fluid is provided by a supply pump that is driven by a motor powered by the output high pressure fluid. A flywheel is associated with this supply pump. In the event of a misfire, the flywheel inertial provides sufficient additional power so that the increased input fluid pressure caused by the pump will drive the engine through its cycle. During normal operation any extra force of the input fluid is not wasted, since it is additive to the driving force provided by the combustion chambers.

BRIEF DESCRIPTION OF THE DRAWINGS

A detailed description of the invention will be made with reference to the accompanying drawings wherein like numerals designate corresponding elements in the several figures.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

Figure 1:
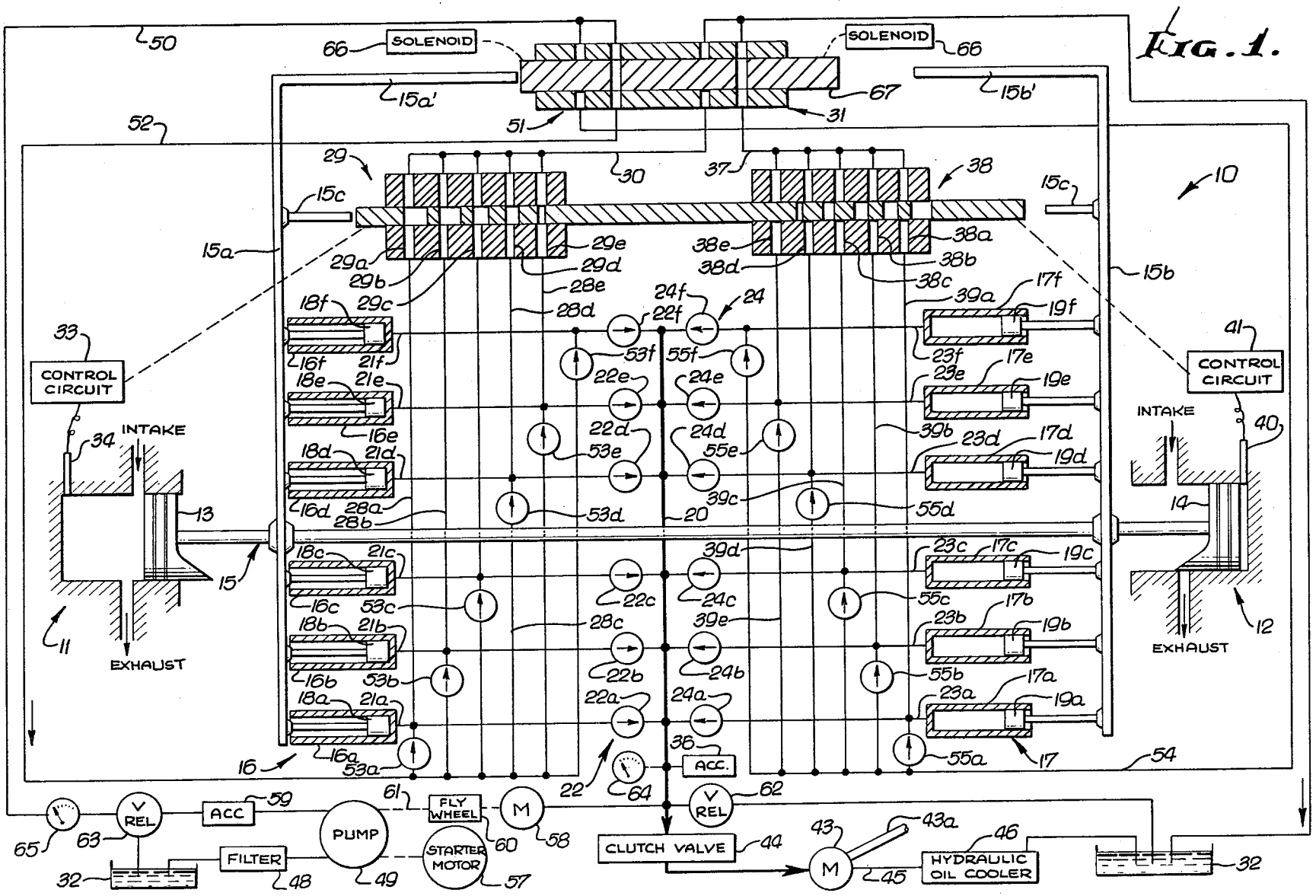
FIG. 1 is a diagrammatic view of an internal combustion assisted hydraulic engine in accordance with the present invention.

As shown in FIG. 1, the inventive hydraulic engine 10 includes a pair of conventional internal combustion chambers 11, 12 that are mounted facing one another. Each such chamber 11, 12 operates as a two-cycle internal combustion engine having a compression stroke and a combustion or power stroke. In FIG. 1, the chamber 11 is shown at the start of its compression cycle, and the chamber 12 is illustrated at the beginning of its power stroke. Details of these chambers 11, 12 are omitted from the drawings, since they are conventional.

Each chamber 11, 12 has a respective piston 13, 14 attached to opposite ends of a rigid shaft 15. During the power stroke of the chamber 12, the piston 14 moves to the left as viewed in FIG. 1, carrying with it the shaft 15 and the piston 13. During the power stroke of the chamber 11, motion in the opposite direction is imparted to the shaft 15 via the piston 13. Thus as combustion occurs alternately in the chambers 11, 12, the shaft 15 reciprocates back and forth.

Associated with each combustion chamber 11, 12 is a respective set 16, 17 of hydraulic cylinders. Although six such cylinders **16*a* – 16*f* and 17*a* – 17*f* are shown in each set 16, 17, the invention is not so limited and each set could include more or fewer cylinders. All of the plungers 18*a* – 18*f* of the set 16 are connected to a rigid member 15*a* that itself is affixed to the shaft 15. Similarly all of the plungers 19*a* – 19*f* of the set 17 are connected to rigid member 15*b* that likewise is affixed to the shaft 15**.

The cylinders 16 are mounted so that additional pressurization of hydraulic fluid in the cylinders occurs during the power stroke of the chamber 11, as the shaft 15 moves to the right. Similarly, the hydraulic cylinders 17 are mounted so that additional fluid pressurization occurs during the power stroke of the chamber 12, as the shaft 15 moves to the left.

The hydraulic engine 10 includes a common hydraulic fluid output line 20 to which pressurized hydraulic fluid is supplied from the set of cylinders 16 or 17 that is being pressurized. To this end, the outlet **21*a* – 21*f* of each cylinder 16 is connected to the output line 20 via a respective one-way or check valve 22*a* – 22*f*. Likewise, each outlet 23*a* – 23*f* from the cylinders 17 is connected to the output line 20 via a respective one-way or check valve 24*a* – 24*f*. Each such check valve 22, 24 permits flow in one direction only, as indicated by the arrows therein so long as the fluid pressure supplied to the respective valve 22 or 24 is at least equal to the pressure in the output line 20**.

During the power stroke of the chamber 11, pressurized hydraulic fluid from the cylinder 16 will be supplied to the output line 20. However, in accordance with the present invention, certain of the cylinders 16 will be effectively disconnected from the output line 20 during this power stroke, so that the load imposed on the chamber 11 will decrease. To this end, each of the cylinder outlets **21*a* – 21*e* is connected via a respective line 28*a* – 28*e* to an associated switching valve 29*a* – 29*e*. There is no such switching valve associated with the single cylinder 16*f***.

At the beginning of the chamber 11 power stroke, all of the valves 29 are closed or blocked. As a result, hydraulic fluid from all of the cylinders 16 is provided via the respective valves 22 to the output line 20. At certain intervals during this power stroke, the switching valves 29a – 29e are opened successively. The outlets of these valves 29 are connected via a common line 30 and a reversing valve 31 to a hydraulic fluid reservoir 32 that is at ambient (essentially zero) pressure. Thus when the first valve 29a is switched open, the outlet 21a of the cylinder 16a is connected via the line 28a, the valve 29a, the line 30 and the reversing valve 31 to the reservoir 32. Immediately the hydraulic fluid pressure at the outlet 21a drops essentially to zero. As a result, there is no flow through the one-way valve 22a, so that the cylinder 16a makes no contribution to the hydraulic fluid being provided under pressure to the output line 20. In other words, opening of the valve 29a vents the cylinder 16a, effectively disconnecting it from the output line 20.

At following intervals during the same chamber 11 power stroke, the valves 29b through 29e are opened. This successively vents the cylinders 16b through 16e, effectively disconnecting them from the output line 20. When all of the valves 29 are open, only the cylinder 16f continues to provide high pressure hydraulic fluid to the output line 20; this is the position shown in FIG. 1.

The valves 29a – 29e may be opened successively by a mechanical linkage 15c that is fixed to the member 15a so as to move with the shaft 15. With such an arrangement, each valve 29 will open as the piston 13 reaches a certain preset position within the chamber 11.

The particular points at which the valves 29a – 29e are switched open during the chamber 11 power stroke need not be fixed. Indeed, these points may be adjusted dynamically in response to certain system parameters. For example, the valves 29 may be opened in response to pressure changes within the combustion chamber 11. To this end, the switches 29 may be solenoid actuated by a control circuit 33 that is responsive to a pressure sensor 34 mounted in the chamber 11. A servo motor may be used to effectively change the timing of valve segments.

Figure 2A:
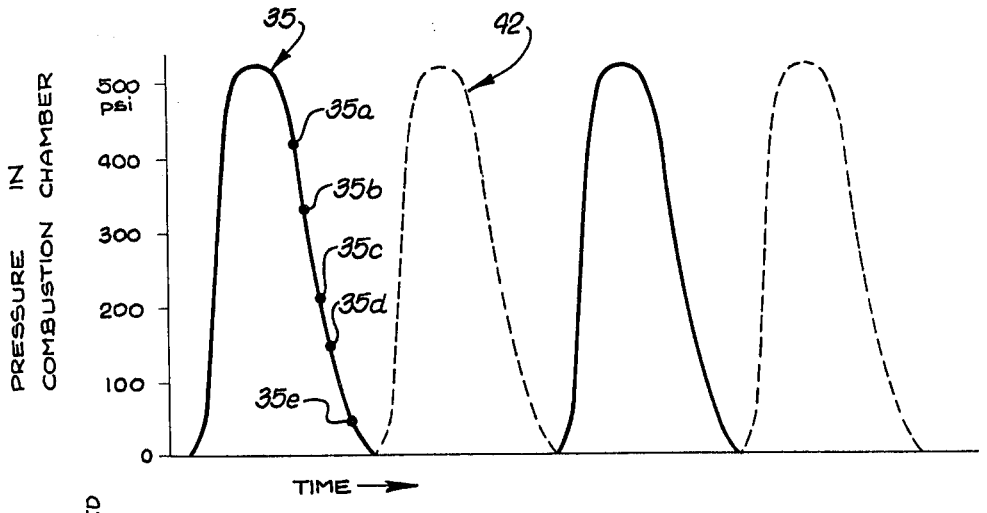
FIGS. 2A through 2D are graphs illustrating operation of the hydraulic engine of FIG. 1.
Figure 2B:
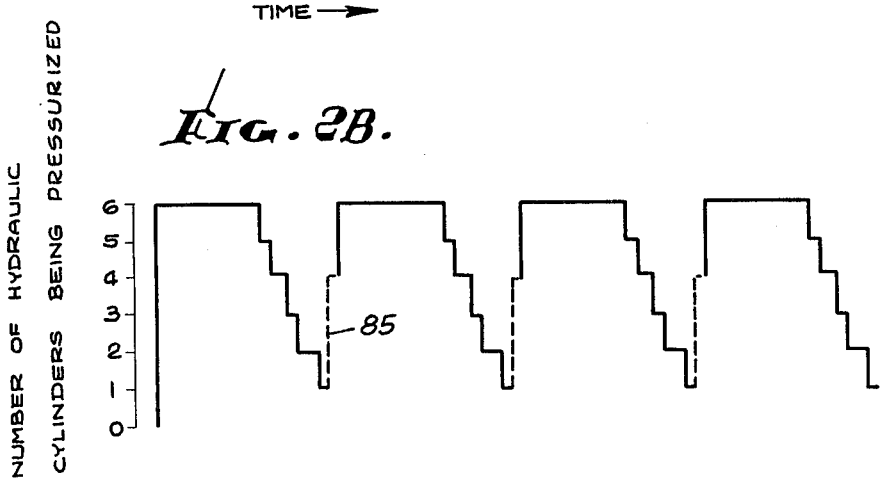

The graphs of FIGS. 2A through 2G typically illustrate this combustion pressure responsive operation. In FIG. 2A, the curve 35 represents the pressure in the chamber 11 during the power stroke, as detected by the sensor 34. When the fuel first is ignited, the pressure rises rapidly to a typical value of 500 psi. The piston 13 is forced to the right by the expanding as in the chamber 11. The gas pressure then begins to drop. The control circuit 33 may be set to open the first valve 29a when the pressure drops to say 420 psi. At this point 35a the hydraulic cylinder 16a is disconnected from the output line 20. As shown in FIG. 2B, five of the cylinders 16 remain connected to the output line 20. Similarly, when the pressure in the chamber 11 drops to successive predetermined values 35b – 35e, the respective cylinders 16b through 16e are disconnected from the outline line 20.

Figure 2C:
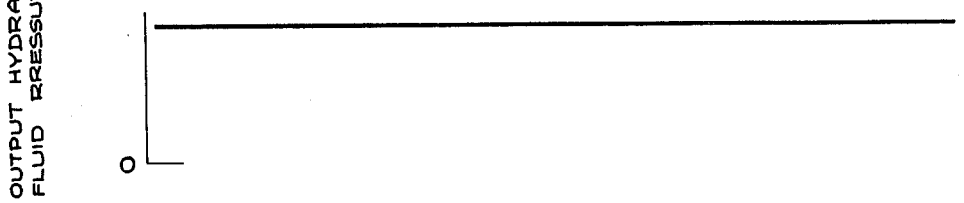
Figure 2D:
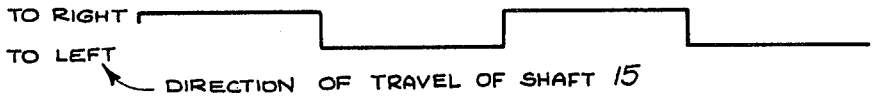

Of significance is the fact that the hydraulic fluid pressure on the output line 20 remains substantially constant during disconnection of the various cylinders, as indicated by the curve of FIG. 2C. This continuous high pressure output is achieved, despite a decrease in the force exerted on the piston 13, as a result of the concomitant decrease in load during the power stroke. In other words, as the force exerted by the combustion gases decreases, the amount or volume of hydraulic fluid that is pressurized likewise decreases. Additional smoothing of the output pressure is provided by the inertial forces of the moving masses including shaft 15, the plungers 18, 19 and their associated rods, and a flywheel 60 discussed below. These inertial forces tend to prevent abrupt changes in velocities of these components. Hence, only a small accumulator 36 is required on the line 20 to compensate for volume variations that may occur as successive cylinders 16 are disconnected.

At the end of the chamber 11 power stroke, the reversing valve 31 is operated to block the path from the conduit 30 to the reservoir 32 and to open a path to that reservoir via a line 37 and a set 38 of switching valves 38a – 38e connected via lines 39a – 39e to the outlets 23a – 23e of the hydraulic cylinders 17. During the subsequent power stroke of the chamber 12, the switching valves 38 function exactly like the valves 29 so as to successively vent or disconnect the cylinder outlets 23a – 23e from the output line 20.

As with the valves 29, the set of switching valves 38 may be actuated mechanically during motion of the shaft 15. Alternatively, the valves 38a – 38e may be solenoid actuated or changed in timing sequence in response to system parameters such as the pressure in the combustion chamber. To that end, a pressure sensor 40 cooperates with a control circuit 41 to actuate the valves 38 at selected pressure points along the combustion pressure cycle indicated by the broken curve 42 in FIG. 2A. As a result of the decreasing load during the chamber 12 combustion cycle, the hydraulic fluid pressure at the output line 20 remains substantially constant, as indicated by the curve of FIG. 2C. By alternating the power strokes in the combustion chambers 11 and 12, this output pressure level is maintained relatively constant during the complete cycle of engine 10 operation.

The high pressure hydraulic fluid on the output line 20 represents the energy output of the engine 10. This pressurized fluid may be provided directly to an external utilization device, or it may be used to drive a fluid motor 43 which develops a mechanical energy output for the engine 10, such as rotation of the motor shaft 43a. A clutch valve 44 in the line 20 may be opened to disconnect the output motor 43, as may be desirable during starting of the engine 10. Spend hydraulic fluid from the motor 43 is returned to the reservoir 32 via a line 45 and a hydraulic oil cooler 46.

During operation of the engine 10, hydraulic fluid is supplied to the cylinders 16 and 17 from the reservoir 32 via a filter 48, a pump 49 and a line 50. The hydraulic fluid in the line 50 is pressurized somewhat by the pump 49, but is at a pressure level that is substantially below the high pressure level on the output line 20. During the chamber 12 power stroke, the hydraulic fluid from the line 50 is supplied via a reversing valve 51, a line 52 and a set of one-way or check valves 53a – 53f to the respective outlets 21a – 21f of the cylinders 16. Since the supplied hydraulic fluid pressure is considerably less than that on the output line 20, the supplied fluid does not flow through the check valves 22. Moreover, since the shaft 15 is moving to the left (as viewed in FIG. 1), the pressure of the hydraulic fluid supplied to the cylinders 16 is additive to the force being exerted by combustion in the chamber 12. At the end of the chamber 12 power stroke, the valve 51 is reversed so that hydraulic fluid from the line 50 will be supplied via the valve 51, a line 54 and a set of check valves 55a – 55e to the respective inlets 23a – 23f of the cylinders 17. Thus hydraulic fluid will be supplied to the chambers 17 during the power stroke of the chamber 11.

To start the engine 10, a starter motor 57 is used to drive the pump 49 and thereby provide the initial hydraulic fluid to the cylinders 16 and 17. Thereafter, some of the high pressure hydraulic fluid from the line 20 is used to drive a variable displacement motor 58 that operates the pump 49 during normal engine operation. An accumulator 59 smooths out slight volume or other variations which may occur on the line 50. Normal starting procedure will automatically charge all of the hydraulic lines and valves and will purge the system of air.

A flywheel 60 is associated with the shaft 61 between the motor 58 and the pump 49. In the event of a misfire, the inertial of the flywheel 60 will continue to operate the pump 49. The pressure of the hydraulic fluid supplied via the line 50 will automatically increase to a pressure sufficient to carry the engine 10 through at least a half cycle despite the absence of a power stroke resulting from the misfire. For example, if the spark plug in the combustion chamber 12 should fail to fire, the hydraulic fluid supplied via the line 52 will cause the plungers in the cylinders 16 to move to the left, carrying with it the shaft 15. The stroke will be completed even though no power is provided by the chamber 12.

Pressure relief valves 62, 63 may be provided respectively for the output line 20 and the hydraulic fluid supply line 50. The pressure on these lines may be monitored by respective pressure indicators 64 and 65.

The reversing valves 31 and 51 may be actuated mechanically or by solenoids 66. Mechanical operation is shown diagrammatically in FIG. 1. At the end of each power stroke, an end 15*a*′ or 15*b*′ of the respective member 15, 15*b* contacts a valve plate 67 associated with the valves 31, 51 to cause reversal thereof.

Figure 3:
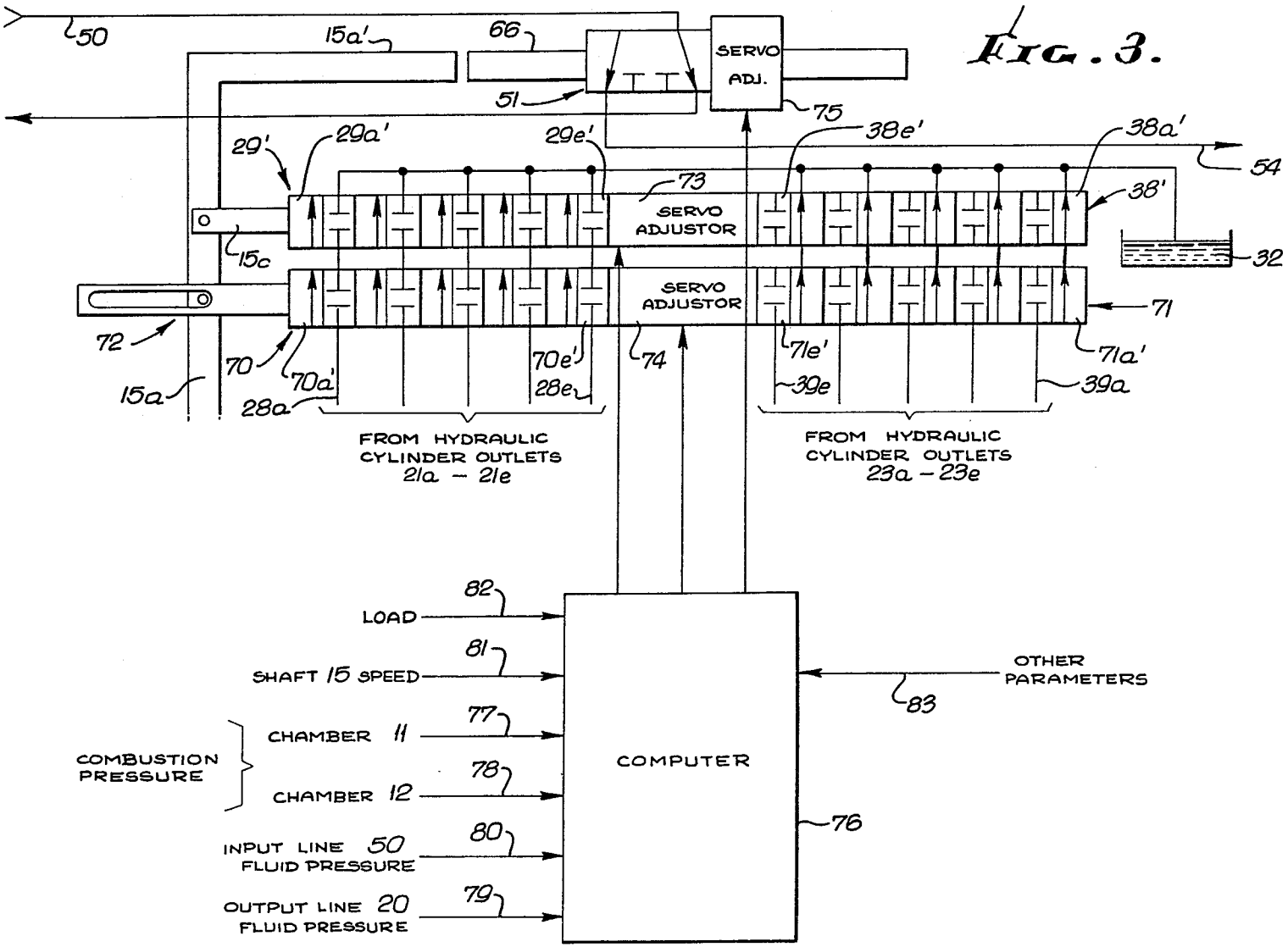
FIG. 3 is a diagrammatic view of an alternative valving arrangement for the hydraulic engine of FIG. 1. The arrangement of valves is shown schematically, since a wide variety of valving arrangements could be used to practice the invention.

In the alternative embodiment of FIG. 3, the reversing valve 31 has been replaced with two sets 70, 71 of switching valves. The set 70 includes valves 70*a* – 70*e* interposed in the respective lines 28*a* – 28*e* from the hydraulic cylinder 16 to the switching valves 29′. Similarly, the set 71 includes valves 71*a* through 71*e* interposed in the lines 39*a* – 39*e* from the cylinder 17 to the switching valves 38′.

The valves 70, 71 are operated by a lost motion connection 72 to the shaft member 15*a*. Thus, when the shaft 15 reaches the right hand extent of its travel, at the end of the chamber 11 power stroke, the valves 71 all are opened and the valves 70 all are closed as shown in FIG. 3. This is the situation at the beginning of the chamber 12 power stroke. At the end of that power stroke, when the shaft 15 reaches its left most limit, the valves 71 will all be closed and the valves 70 will be opened. The main purpose of valves 70 and 71 is to prevent fluid loss through valves 29 and 38 during the compression strokes of cylinders 11 and 12.

The arrangement of FIG. 3 is particularly useful where the venting valves 29′ and 38′ are implemented using a sliding plate mechanism similar to that illustrated in FIG. 1. In such instance, the plate or plates functioning as the valves 29′ 38′ could be mounted to move in a plane parallel to and adjacent the plate or plates functioning as the switching valves 70 and 71. If separate plates with multiple segments are used for the individual valves 29′ and 38′ (likewise for the valves 70 ad 71), these could be relatively positionable with respect to each other and each segment so that dynamic adjustment can be made of the successive opening or closing time of each such valve. In this regard, the timing sequence for both opening and closing each individual valve 29, 38 (or 29′, 38′,) 70 and 71 can be selectively or dynamically adjusted for maximum efficiency under any given set of engine operating parameters.

The individual valves 29*a*′ – 29*e*′ and 38*a*′ and 38*e*′ need not be actuated at fixed positions with respect to the shaft 15 travel. Rather, the operational cycling of these valves 29′, 38′ may be adjusted in response to certain system parameters. To this end, a servo adjuster 73 may cooperate with the valves 29′ and 38′. Such a device may comprise a servo system and cooperative solenoids, motors or the like which function to change the timing and/or order in which the individual valves 29′, 38′ are opened during the engine 10 cycle. Similarly, the valves 70, 71 may be operated in response to system parameters using a servo adjuster 74. The reversing valve 51 that controls switch-over of the input fluid between the cylinders 16 and 17 likewise may be controlled by a servo adjuster 75.

The servo adjusters 73, 74, 75 may be operated by a computor 76 which receives as inputs signals indicating various engine 10 parameters. For example, the computer 75 may receive via a pair of lines 77, 78 signals from the sensors 34, 40 (FIG. 1) that indicate pressure in the combustion chambers 11 and 12. Signals indicating the output fluid pressure on the line 20 and the input fluid pressure on the line 50 from appropriate sensors connected to those lines may be provided to the computer 76 via the respective lines 79 and 80. The speed of the shaft 15 may be reported to the computer 76 via the line 81. This signal may be indicative of instantaneous speed or acceleration of the shaft 15, or may indicate this speed in terms of number of reciprocations per unit time. A measure of the load on the engine 10 may be supplied to the computer 76 via a line 82. For example, this load might be indicated by the torque or drag on the shaft 43*a* of the output fluid motor 43. Other system parameters may be supplied to the computer 76 via a line 83.

The computer 76 advantageously would be programmed to cause adjustment of the various valves 29′, 38′, 70, 71, 51 in some preprogrammed manner in response to the parameters supplied to the computer 76. For example, the switching valves 29′, 38′ could be programmed to open at different combustion chamber pressure levels as a function of engine speed. Thus, at relatively low speed, all five cylinders 16*a* – 16*b* or 17*a* – 17*e* may be disconnected during each power stroke, as indicated by the curve of FIG. 2B. However, at higher engine speeds, the pressure levels at which these cylinders are disconnected could be changed, or fewer cylinders may be vented. Thus, at high speeds, perhaps three or four cylinders in each set 16, 17 would be vented, so that near the end of each power stroke, there would be two or three hydraulic cylinders still being compressed by the combustion force in the chamber 11 or 12. Other permutations are a matter of design choice.

One particularly useful variation concerns deceleration of the shaft 15 near the end of each power stroke. This deceleration can be controlled in the inventive engine 10 by switching in additional hydraulic cylinders 16, 17 to increase the load either abruptly or gradually near the end of each power stroke.

This is illustrated by the dotted curve 85 in FIG. 2B. In this example, near the end of each power stroke, three of the hydraulic cylinders that have been previously vented are effectively reconnected to the output line 20. This abruptly increases the load, thereby rapidly decelerating the shaft 15. Several benefits are achieved. First, the extent of travel of the pistons 13, 14 effectively is limited, thereby establishing the compression ratio for the chambers 11, 12. In other words, the compression ration can actually be modified dynamically as the engine is operating by selectively increasing the hydraulic compression load during each power stroke. Secondly, maximum energy transfer is achieved. The inertial energy in the shaft 15 and the members attached thereto is effectively converted to hydraulic force by increasing the load at the end of the cycle to absorb all of this kinetic energy.

Another benefit of controlling the hydraulic load during each power stroke is that the piston 13, 14 movement can be adjusted so that the exploding gases in the chambers 11, 12 can expand and produce force at the optimum rate. Optimum useful work is produced throughout the entire power stroke. Complete combustion is achieved with maximum energy conversion efficiency. For vehicle applications, this means greater gasoline mileage with fewer pollutant by-products.

Although the combustion chambers 11, 12, described herein are of the two-stroke variety, the invention is not so limited. For example, four-cycle engines may be used to drive the shaft 15. In such instance, the hydraulic loading provided by the cylinder 16, 17 would be applied only during the power stroke of each combustion chamber.

Although two combustion chambers are shown in FIG. 2, the invention is not so limited, and multiple chambers could be used. Furthermore, two or more engines 10 can be coupled together so that their pressurized fluid output lines 20 terminate in a common line. Such an arrangement has several benefits. For example, under light loads, only one engine 10 need operate, but when an increased load is encountered, both engines could function to provide the necessary output power. Furthermore, in such a dual arrangement, the timing could be arranged so that the shafts 15 in the separate units are reciprocating in opposite directions. In this manner, vibration would be kept to a minimum since equal masses always would be moving in opposite directions.

The engine 10 is capable of high pressure output even at a low number of strokes per minute. By connecting the output fluid line 20 to a motor 43 of variable displacement, the engine 10 can produce a wide range of variable torques and output shaft speed combinations. Similarly, a given engine 10 can produce a wide range of horsepower, due to its ability to operate either at very low or high number of strokes per minute and with different fluid pressures. Mechanical and thermal efficiencies are high as compared with conventional internal combustion engines.

The inventive hydraulic engine could be powered by means other than the internal combustion chambers illustrated herein. Thus, e.g., the chambers 11, 12 could be replaced by compressed gas expansion chambers powered by pressurized nitrogen or other gas. Such nitrogen stored in a liquid form can produce high pressure when returned to a gas. When gated alternately into opposing chambers, the force of the expanding gas, exerted against pistons in the chambers, would impart reciprocation to the shaft 15 of the inventive engine 10.

Although single acting hydraulic cylinders are shown in the drawing, the invention is not so limited. Alternatively, double acting cylinders, in which fluid is pressurized alternately on opposite sides of a piston in a single chamber, could be employed. Similarly, instead of single acting combustion chambers, the inventive engine could employ a double acting internal combustion chamber wherein combustion occurs alternating on opposite sides of a single piston. Furthermore, hydraulic fluid need not be employed; any suitable fluid could be used.

The valving arrangements shown herein are illustrative only; other mechanization could be used. For example, one complex rotary valve could replace almost all of the system valves, since these operate on a 360° cycle.

Figure 4:
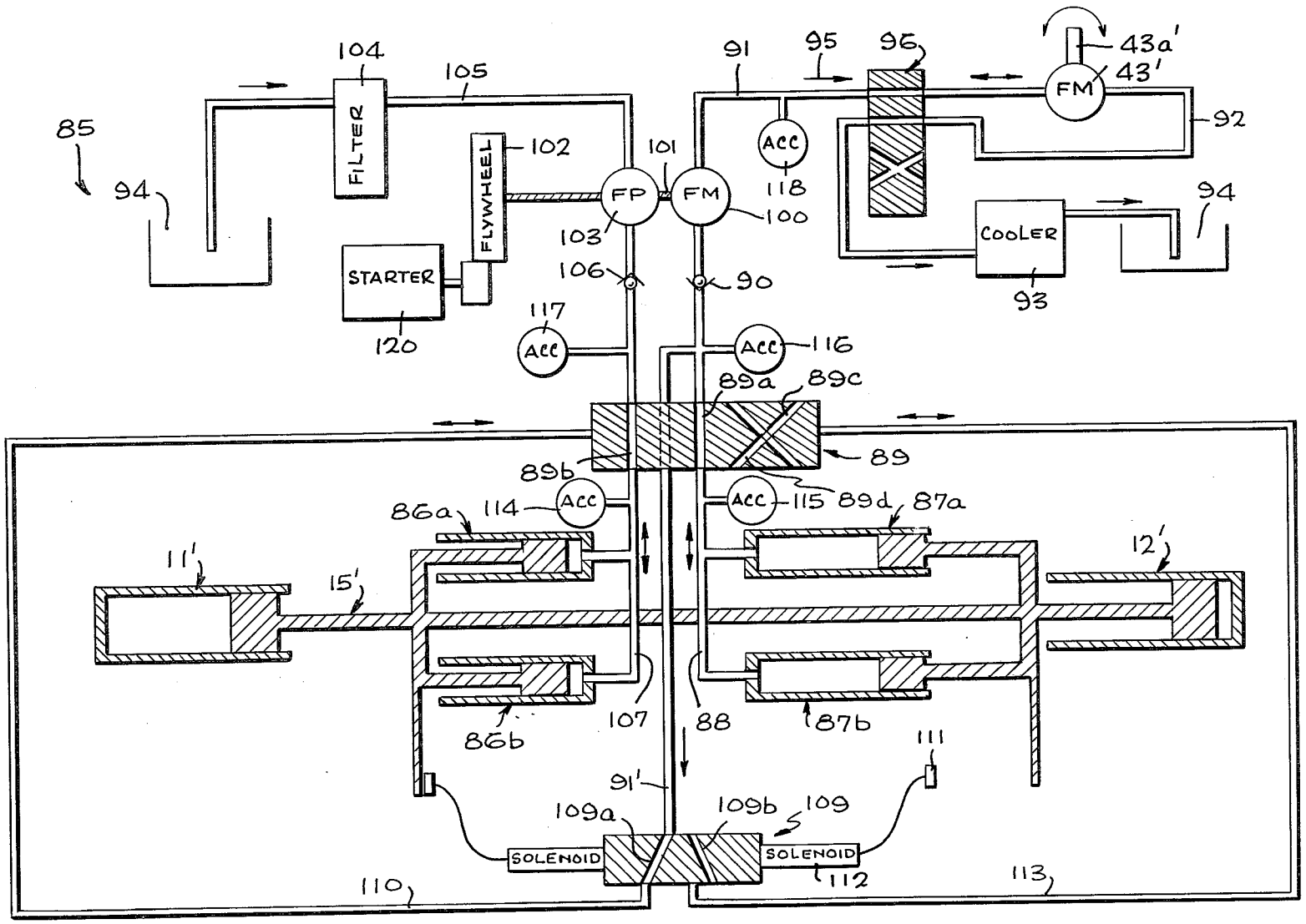
FIG. 4 is a diagrammatic view of another inventive hydraulic engine.

Referring now to FIG. 4, there is shown another embodiment 85 of the present invention. As in the other embodiments, the engine 85 employs a pair of conventional internal combustion chambers 11', 12' connected to impart reciprocation to a shaft 15'. This shaft 15' is connected to the plungers of a first set of hydraulic cylinders **86*a*, 86*b* so as to compress the hydraulic fluid during the combustion cycle of the chamber 11', and is connected to the plungers of a second set of hydraulic cylinders 87*a*, 87*b* so as to compress the hydraulic fluid in that set during the combustion cycle of the chamber 12'**.

In FIG. 4, the engine 85 is shown at the beginning of the combustion cycle of the chamber 12'. During this cycle, the shaft 15' is driven to the left, causing the hydraulic fluid from the cylinders **87*a*, 87*b* to be pressurized and forced via a line 88, a switchover valve 89 and a one-way valve 90 to a common hydraulic fluid output line 91. A fluid motor 43' is driven by the output hydraulic fluid in the line 91, and serves to impart mechanical energy to a shaft 43*a'* which is the system mechanical output. Expended hydraulic fluid from the motor 43' flows through a line 92 and a cooler 93 into a reservoir 94. Hydraulic fluid flow in the line 91 always is in the direction indicated by the arrow 95. A reversing valve 96 may be used to change the direction of fluid flow to the output motor 43', and thereby change the direction in which the output shaft 43*a'*** *is driven.*

Interposed in the common output line 91 is a fluid motor 100 connected via a shaft 101 to a flywheel 102 and to a fluid pump 103. The pressurized fluid outlets of the cylinders **87 *a* and 87*b* both remain connected to the line 88 throughout the combustion cycle of the chamber 12'. During periods of high energy output from the chamber 12', the fluid motor 100 imparts energy to the flywheel 102. Later in the combustion cycle, when the energy output from the chamber 12' is reduced, the energy stored in the flywheel 102 serves to drive the fluid pump 103, and thereby assist (in a manner next to be described) in maintaining the hydraulic fluid pressure in the output line 91** at a constant high level.

To this end, the pump 103 is connected to supply hydraulic fluid from the reservoir 94 via a filter 104, a line 105, a one-way valve 106, the switchover valve 89 and a line 107 to the pressurized fluid outlets of the other set of hydraulic cylinders **86*a*, 86*b***.

During the combustion cycle of the cylinder 12', as the shaft 15' is moving to the left, the pump 103 is forcing hydraulic fluid into the cylinders **86*a* and 86*b*. Since the plungers of these cylinders 86*a*, 86*b* are connected to the shaft 15', this assists in moving that shaft 15' to the left. As the energy output from the chamber 12' decreases, the energy stored in the flywheel 102 is imparted to the pump 103, so as to force additional hydraulic fluid via the line 107 into the cylinders 86*a* and 86*b*. The resultant force, transmitted via the shaft 15' to the plungers of the hydraulic cylinders 87***a*, 87*b*, serves to boost the pressure of the output hydraulic fluid supplied to the common output line 91. In this manner, the pressure on the line 91 is held at a substantially constant, high value throughout the combustion cycle of the chamber 12'.

As the shaft 15' is moving to the left (FIG. 4), some of the output hydraulic fluid is diverted via a branch line 91', a channel 109*a* in a valve 109 and a line 110 to the switchover valve 89. This hydraulic pressure maintains the valve 89 in the position shown in FIG. 4, wherein the straight channels 89*a*, 89*b* respectively are interposed in the lines 88 and 107. At the end of the combustion cycle of the chamber 12', when the shaft 15' reaches its left-most position, a switch 111 is closed to energize a solenoid 112. This moves the valve 109 to the position in which a channel 109*b* connects the line 91' to another line 113 that leads to the other end of the switchover valve 89. Fluid pressure in this line 103 causes the switchover valve to be transferred so as to interpose the cross-over channels 89*c*, 89*d* into use. The channel 89*c* connects the line 107 from the cylinders 86*a*, 86*b* to the common output line 91. Thus during combustion in the chamber 11', as the shaft 15' moves to the right, output fluid from the cylinders 86*a*, 86*b* is supplied via the output line 91 to the output motor 43'. The channel 89*d* connects the fluid pump 103 to the line 88. This facilitates the boost operation as the flywheel 102 causes the pump 103 to supply hydraulic fluid to the cylinders 87*a*, 87*b* during periods of reduced output in the combustion cycle of the chamber 11'. A pair of accumulators 114, 115 are used to absorb fluid while the valve 89 is switching. Additional accumulators 116–118 are provided in association with the one-way valves 90, 106 and the output line 91. An electric starter motor 120 is used to drive the flywheel 102 to begin operation of the engine 85.

A particular advantage of the engine 85 is that reciprocation speeds are much lower than in a conventional internal combustion engine. Thus there is no need for pre-ignition before "top dead center", which opposes rotation in a conventional engine. As a result, the engine 85 has greater thermal efficiency than a conventional internal combustion engine.

Another advantage of the present engine 85 relates to the stroke length. Conventional internal engines use a short stroke at high speed, a mode of operation which prevents complete combustion of the fuel mixture. The inventive engine 85 may have a very long stroke, thus allowing more complete combustion of the fuel mixture. The hot exhaust gasses are retained for a longer period of time in the combustion chambers, and allowed to expand more fully, and thus impart more energy to the system. Moreover, the compression can be changed easily, thus allowing fuels of different octane rating to be used. The fuel can be compressed with the air mixture to a point just prior to pre-ignition, thereby ensuring optimum thermal efficiency for that particular octane rating. Diesel fuel or gasoline could be used in the same engine.

Another advantage of all of the engines of the present invention is that the output may be in a fluid form, which can be used to drive the wheels of a vehicle directly by a fluid motor which has high energy conversion efficiency. This arrangement eliminates the energy losses associated with the low mechanical efficiency of the drive train in a conventionally powered vehicle.

An an alternative to deriving the ouptut driving force from the motor 43 or 43', a mechanical output can be obtained directly from the flywheel 60 (FIG. 1) or flywheel 102 (FIG. 4).

The compression ratio of the engine 10 or 85 can be altered by adjusting the position on each stroke that the motion is reversed by the valve 51 or 89. For example, this can be accomplished by relocating each solenoid switch 111. At the same time, the operating points of the intake and exhaust valves for the combustion chambers 11, 12, 11', 12' can be adjusted to start compression at an earlier or later time. The effect is to permit adjustment of the engine compression ratio and effective displacement.

Intending to claim all novel, useful and unobvious features shown or described, the inventor makes the following

I claim:

1. A hydraulic engine comprising:

first and second sets of hydraulic cylinders, the pressurized fluid outlet of each cylinder being connectable to a common output line, the pistons of all cylinders being mechanically attached to a common shaft, chamber assisted means for reciprocating said shaft alternately to pressurize the hydraulic fluid in said first and second sets, and hydraulic fluid supply means including:

a hydraulic fluid reservoir, a pump for pumping hydraulic fluid from said reservoir to all of the hydraulic cylinders in the set that is not currently being pressurized, a motor driven by pressurized hydraulic fluid from said output line, and a flywheel connected to said pump and to said motor.

2. A hydraulic engine according to claim 1 wherein each set of hydraulic cylinders contains more than one cylinder together with:

means for selectively, effectively connecting to the output line the outlets of certain hydraulic cylinders in the set being pressurized, so that only the pressurized fluid from said connected cylinders is supplied to said output line, whereby the output line pressure remains substantially constant despite changes in force exerted by said assisted means during the pressurization cycle.

3. A hydraulic engine according to claim 11 wherein the pressurized fluid outlets of all of the hydraulic cylinders in each respective set remain connected to said common output line throughout movement of said shaft in a direction that pressurizes the fluid in that respective set.

4. A hydraulic engine according to claim 1 further comprising:

switchover valve means, operative upon completion of said shaft movement in a direction that pressurizes, for switching over said common output line to the pressurized fluid outlets of the other set of hydraulic cylinders, and for concurrently switching over the output of said pump in said hydraulic fluid supply means to that set of hydraulic cylinders in which fluid pressurization has just been completed.

5. A hydraulic engine according to claim 4 wherein said switchover valve means is hydraulically actuated upon completion of the movement of said shaft in each pressurizing direction.

6. A hydraulic engine according to claim 4 further comprising:

means for adjusting said switchover valve means to control the distance of travel of said shaft, and means for controlling the power cycle of said chamber assisted means, thereby to vary the compression ratio and effective displacement of said engine.

7. An internal combustion assisted hydraulic engine comprising:

a pair of internal combustion chambers each having a piston, a common shaft connecting said pistons, alternate combustion strokes of said chambers imparting reciprocation to said shaft, first and second pluralities of hydraulic cylinders having plungers attached to said shaft for pressurizing hydraulic fluid in said first plurality as said shaft reciprocates in one direction and for pressurizing hydraulic fluid in said second plurality as said shaft reciprocates in the opposite direction, a common output line, a one-way valve connecting the outlet of each hydraulic cylinder to said common output line, said one-way valves permitting passage to said output line only of hydraulic fluid having a pressure at least equal to that in said output line, selective venting means for venting the outlet of selected hydraulic cylinders to a reservoir pressure substantially lower than said output line pressure for a portion of the chamber combustion stroke causing pressurization in that cylinder, and fluid supply means for supplying hydraulic fluid to each plurality of hydraulic cylinders while said shaft is moving in the direction not causing pressurization of the hydraulic cylinders in that plurality.

8. A hydraulic engine according to claim 7 wherein said fluid supply means comprises:

a pump for pumping hydraulic fluid from a reservoir at a pressure above said reservoir pressure but substantially below said output line pressure, said pumped hydraulic fluid being supplied to said hydraulic cylinders, a variable displacement hydraulic motor powered by the pressurized fluid on said output line, said motor driving said pump, a flywheel associated with said pump, and a reversible valve, reversed in response to change in shaft direction, for connecting said pumped hydraulic fluid to the hydraulic chambers not being compressed.

9. A hydraulic engine according to claim 7 wherein said fluid supply means comprises:

a hydraulic fluid reservoir, a pump for supplying hydraulic fluid from said reservoir to each hydraulic cylinder between consecutive combustion strokes of the chamber causing compression of that cylinder, said pump supplying said fluid at a pressure level above reservoir pressure but substantially below the pressure level in said output line, said pump being powered by pressurized hydraulic fluid from said output line, and a flywheel associated with said pump, the inertia of said flywheel being sufficient to operate said pump in the event of a misfire.

* * * * *